US008156583B2

(12) United States Patent
Lobry et al.

(10) Patent No.: US 8,156,583 B2
(45) Date of Patent: Apr. 17, 2012

(54) MULTI-MATERIAL SLAT CAP

(75) Inventors: Jacques Lobry, Bourges (FR); Jean-Jacques Bonnefoy, Bourges (FR); Christophe Tat, Bourges (FR)

(73) Assignee: Tournadre SA Standard Gum, Bourges (FR)

( * ) Notice: Subject to any disclaimer, the term of this patent is extended or adjusted under 35 U.S.C. 154(b) by 187 days.

(21) Appl. No.: 11/919,329

(22) PCT Filed: Apr. 27, 2006

(86) PCT No.: PCT/FR2006/050397

§ 371 (c)(1),
(2), (4) Date: Mar. 20, 2008

(87) PCT Pub. No.: WO2006/114555

PCT Pub. Date: Nov. 2, 2006

(65) Prior Publication Data

US 2009/0282613 A1 Nov. 19, 2009

(30) Foreign Application Priority Data

Apr. 27, 2005 (FR) ..... 05 04256

(51) Int. Cl.
*A47C 23/06* (2006.01)

(52) U.S. Cl. ..... 5/236.1; 5/238; 5/241

(58) Field of Classification Search ..... 5/236.1–245
See application file for complete search history.

(56) References Cited

U.S. PATENT DOCUMENTS 6,718,575 B1 * 4/2004 Lubeck et al. ..... 5/236.1
7,069,606 B2 * 7/2006 Verschuere et al. ..... 5/236.1

FOREIGN PATENT DOCUMENTS

EP 1 371 308 A 12/2003
EP 1 462 032 A 9/2004

* cited by examiner

*Primary Examiner* — Robert G Santos
*Assistant Examiner* — Nicholas Polito
(74) *Attorney, Agent, or Firm* — Kenyon & Kenyon LLP

(57) ABSTRACT

This invention relates to a springer slat suspension device formed by a cap having an upper section which comprises at least one housing for accepting the end of a slat, a lower section provided with means of anchoring the said cap on a springer frame and an intermediate section comprising suspension elements linking the lower section with the upper section, the intermediate section being essentially made of a first material of the flexible type, whereas the lower section is made of a second material of the rigid type. This invention is characterized in that the intermediate section and the lower section are made in one single piece by molding.

16 Claims, 7 Drawing Sheets

MULTI-MATERIAL SLAT CAP

This is a 371 national phase application of PCT/FR2006/050397 filed 27 Apr. 2006, claiming priority to French Patent Application No. FR 0504256 filed 27 Apr. 2005, the contents of which are incorporated herein by reference.

This invention relates to the area of elastic suspension of slats of a slat springer.

It relates more precisely to a device for the suspension of slats of a springer, of the type including a cap having an upper section which comprises at least one housing for accepting the end of a slat, a lower section provided with means of anchoring the said cap on a springer frame and an intermediate section comprising suspension elements linking the lower section with the upper section, the intermediate section essentially being made of a first material of the flexible type whereas the lower section is essentially made of a second material of the rigid type.

In general, caps of this type are formed in two separate parts suitable for fitting or clipping into each other. In the case in point, the first part is formed by the upper section and intermediate section, whereas the second part is formed by the lower section.

Furthermore, the first part is formed from a flexible material providing the suspension elements with their elastic property, whereas the second part is formed from a rigid material providing the anchoring means with the rigidity necessary for fastening them to the springer frame.

Fitting such caps to a springer frame is not easy because of their configuration in two parts, which makes a preliminary assembly stage necessary.

In addition, it can happen that, after they have been fitted to the springer frame, the two parts become disconnected, particularly because of the mechanical stresses which can exist between the anchoring means and the springer frame.

The meaning of "essentially being made" of a first or second material is understood to be that the corresponding section can also include an additional element made of a material other than the first one but that its structure and mass are mainly formed by the material in question, whereas another material is, at the very most, present in certain areas of the section considered.

The aim of the invention is to rectify these drawbacks substantially.

The invention achieves its aim due to the fact that the intermediate section and the lower section are made in one single piece by moulding and due to the fact that the lower section comprises a plate holding the anchoring means and in that the plate is housed in a recess formed in the intermediate section.

Due to the one-piece formation of the cap according to the invention, fitting is made easier and untimely disconnections are avoided. In addition, the meaning of "housed" is understood to be that the plate is not embedded in the intermediate section. In other words, according to this invention, the plate is not covered by the first material but can, however, be bounded by the first material.

According to a first embodiment, the upper and intermediate sections are essentially made of the first material, whereas the lower section is essentially made of the second material.

According to a second embodiment, the upper section is made of a third material and the upper section is formed in one single piece with the lower and intermediate sections.

According to a variant, the cap also comprises means of reinforcing the suspension elements, the said means being formed from a rigid type of material, advantageously the second material.

With these means, the suspension formed by the suspension elements can be stiffened but they are positioned so that they can deform nevertheless.

Advantageously, the reinforcing means are formed integrally with the lower section.

The reinforcing means can be external to the suspension elements or alternatively moulded together with them.

According to this variant, it is not, therefore, necessary to add a supplementary part for stiffening the suspension.

Advantageously, the reinforcing means have the form of portions of rings surrounding at least one of the suspension elements.

Preferably, the portions of rings are formed integrally with the plate during moulding.

According to a variant, the anchoring means comprise elastically deformable clipping means situated on a support board substantially at right angles to the plate.

With these clipping means it is intended that the cap can be fastened to a springer having a tube provided with an opening.

According to another variant, the anchoring means comprise a pair of studs.

According to another variant, the anchoring means comprise a pair of "Ω" shaped sleeves.

Preferentially but not necessarily, the anchoring means also comprise a housing for a third slat.

It is also understood that the reinforcing means can advantageously be associated with each of the examples of anchoring means mentioned above.

The invention also relates to a process for obtaining the cap according to the invention.

Advantageously, the anchoring means are moulded together with the intermediate section.

According to a first variant, the anchoring means are co-moulded with the intermediate section.

According to a second variant, the moulding is carried out by bi-injection.

According to a third variant, the plate is over-moulded with the intermediate and upper sections.

The invention will be understood better and its advantages will appear better when the following detailed description of embodiments, indicated by way of non-limiting examples, is read. The description refers to the appended drawings, in which.

Figure 2:
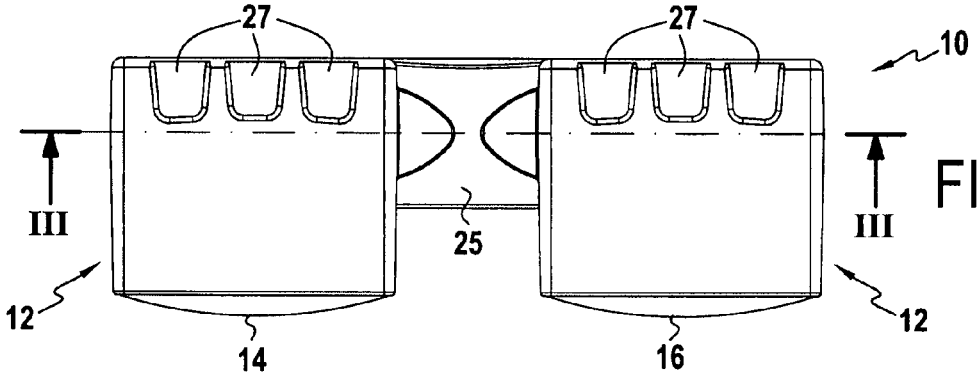
FIG. 2 shows a plan view of the cap according to the invention.
Figure 3:
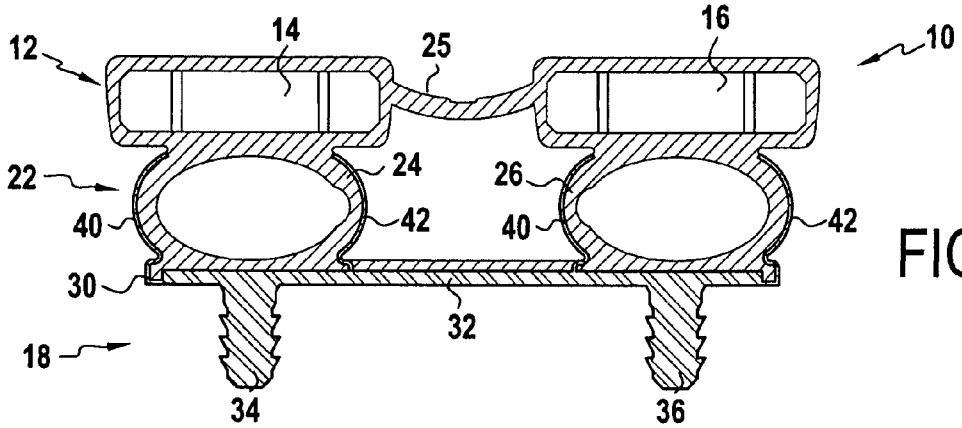
Figure 4:
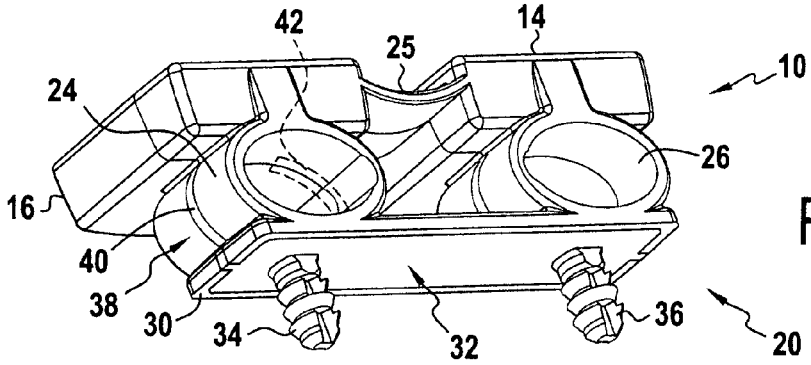
Figure 5A:
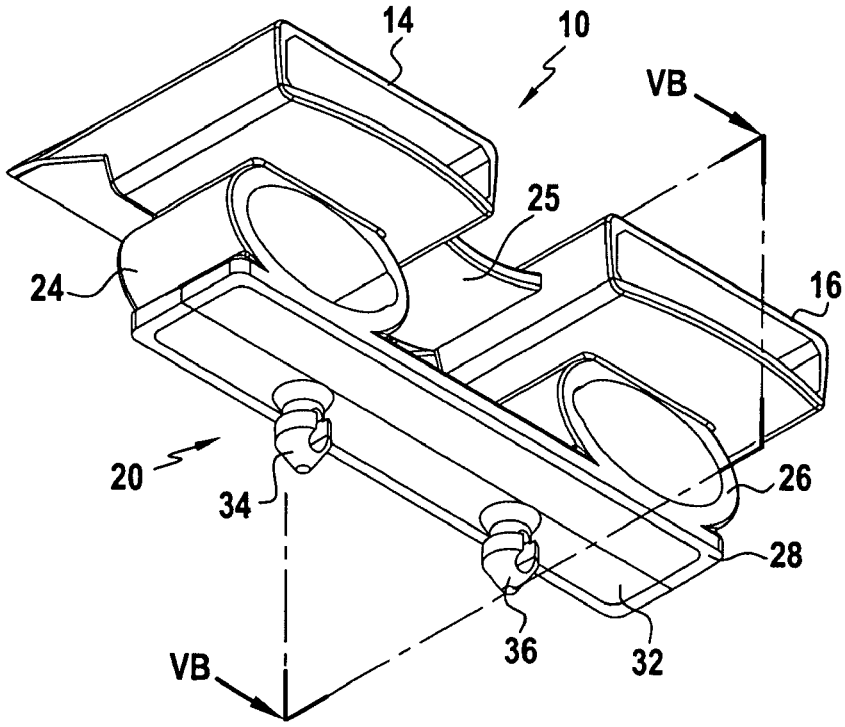
Figure 5B:
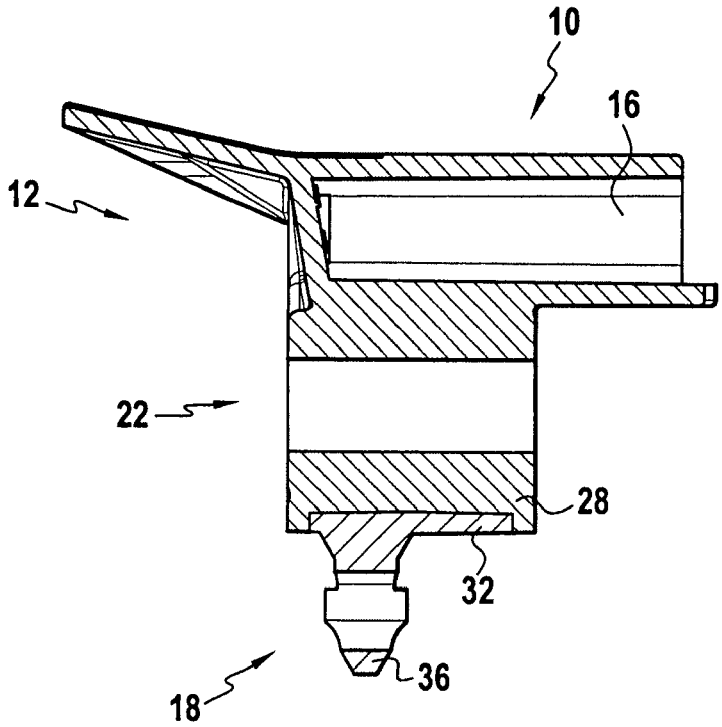
Figure 6A:
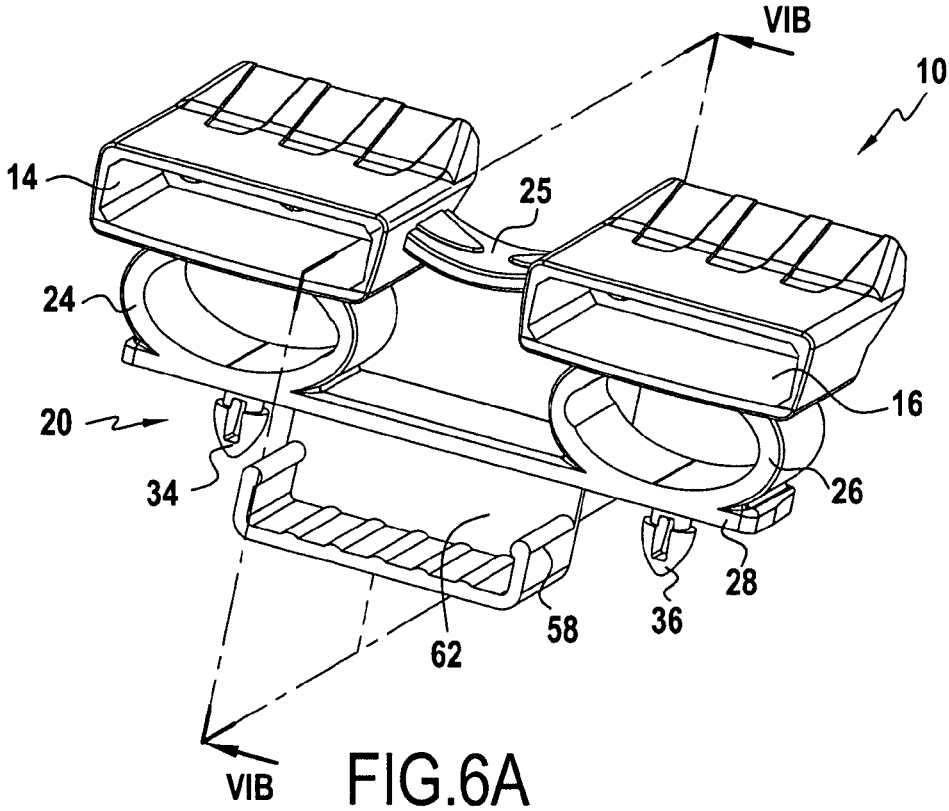
Figure 6B:
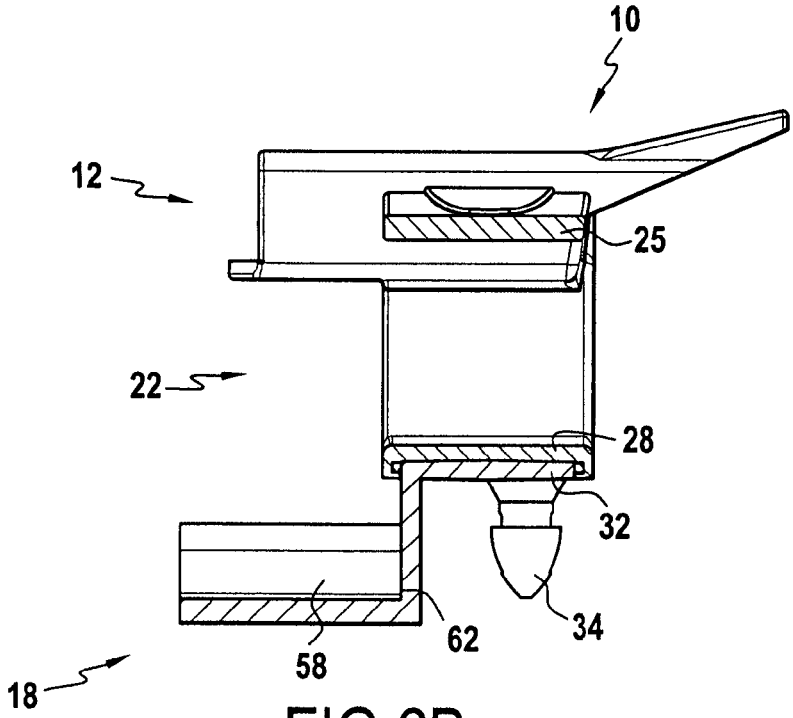
Figure 7A:
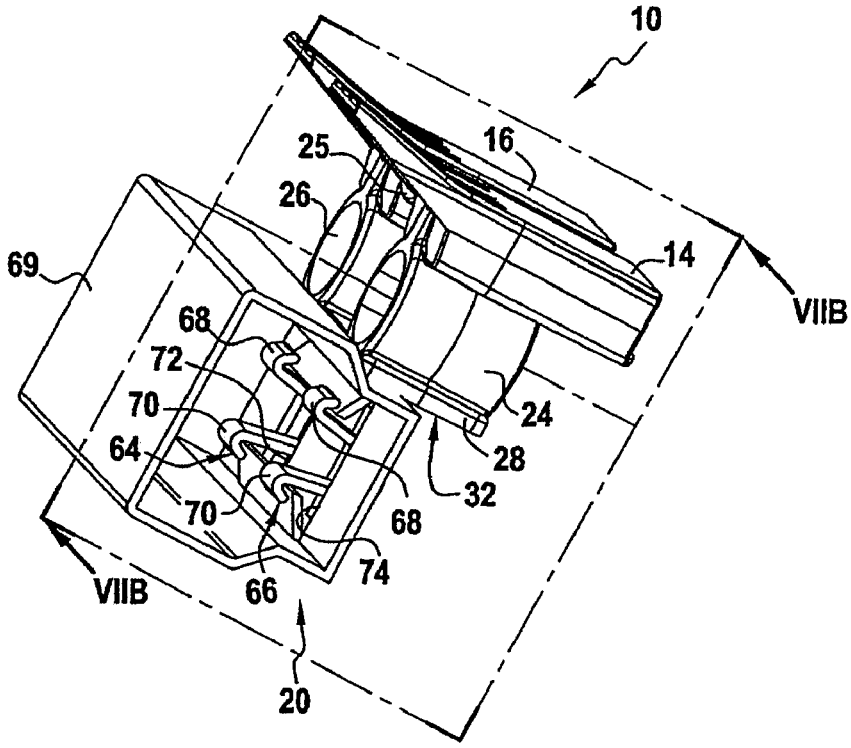
Figure 7B:
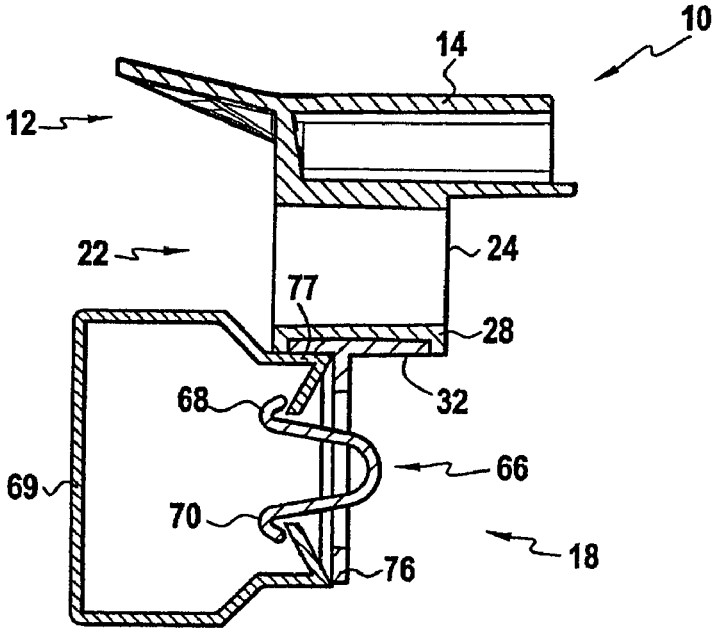
Figure 8A:
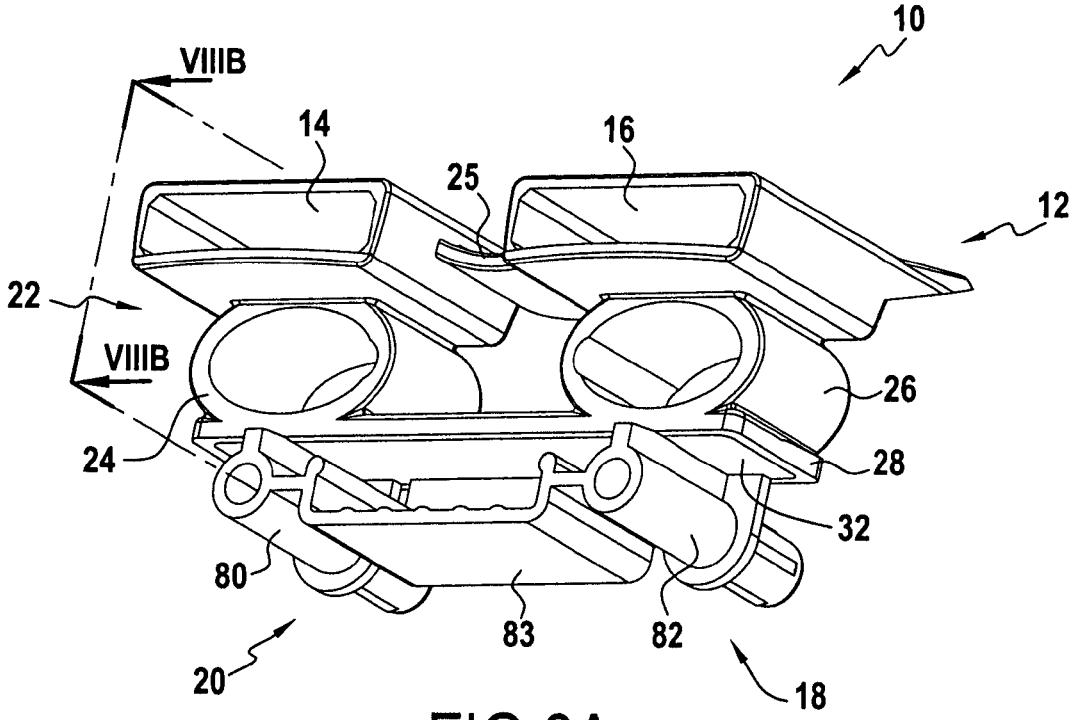
Figure 8B:
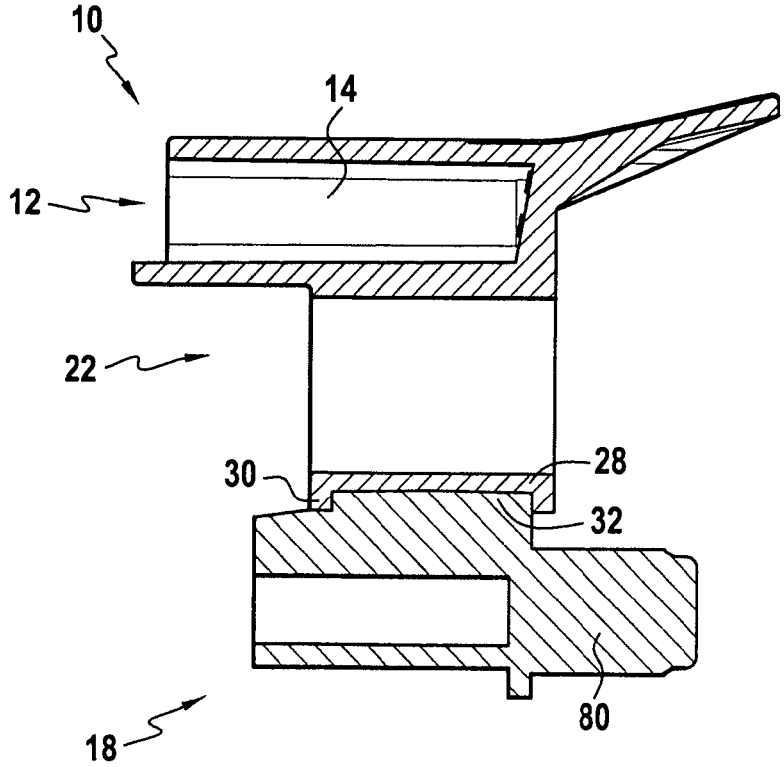
Figure 9A:
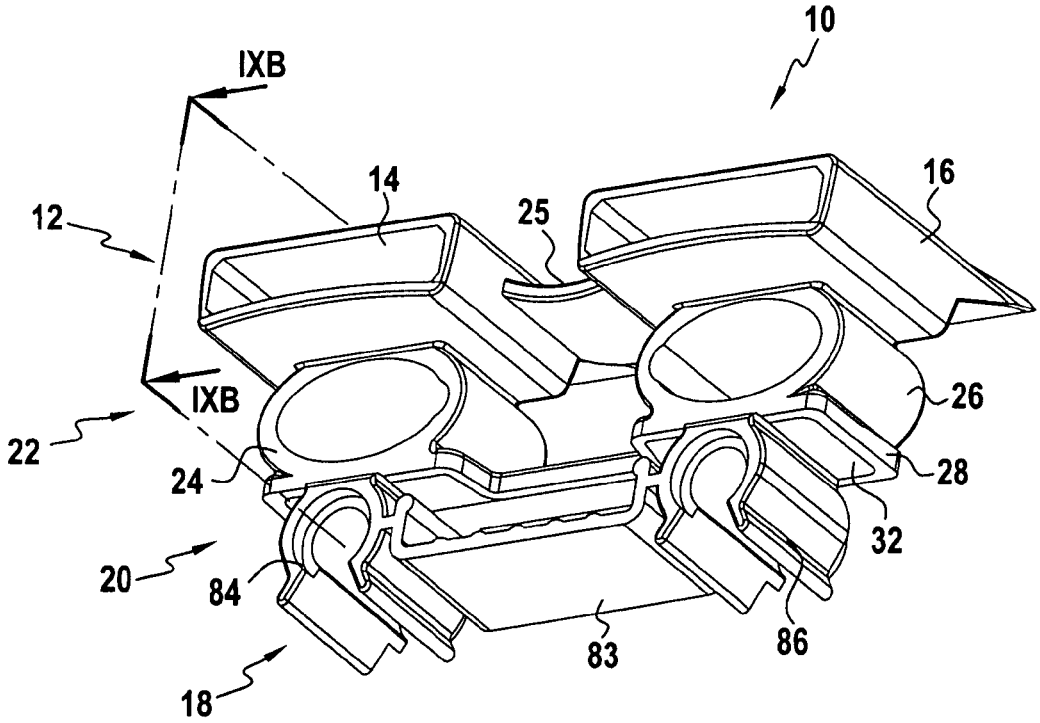
Figure 9B:
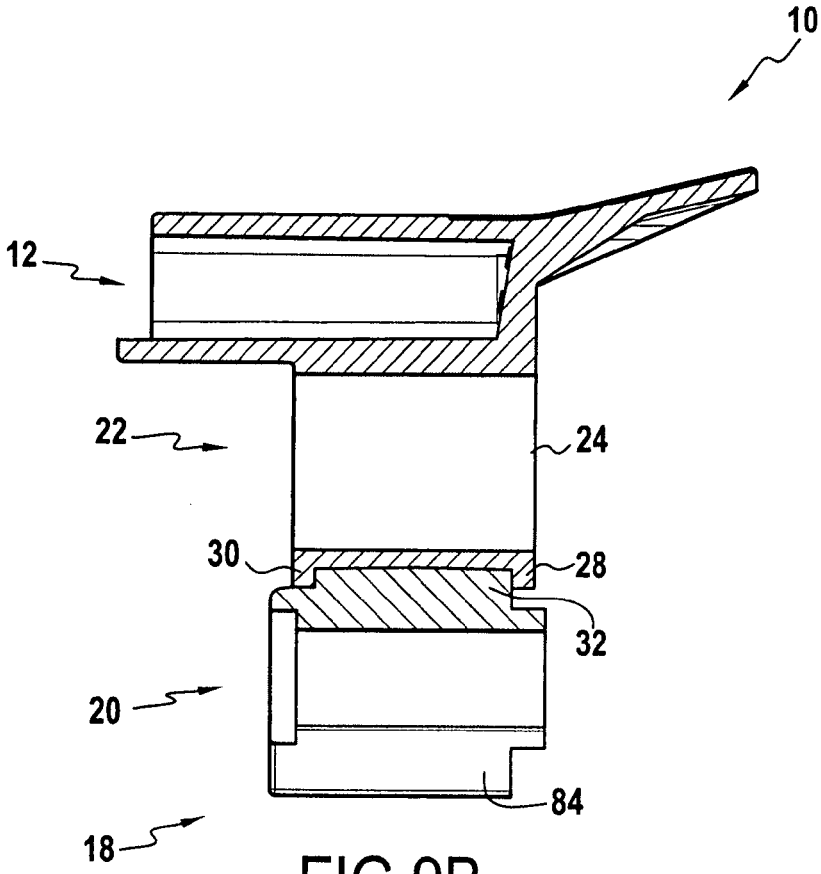
Figure 10A:
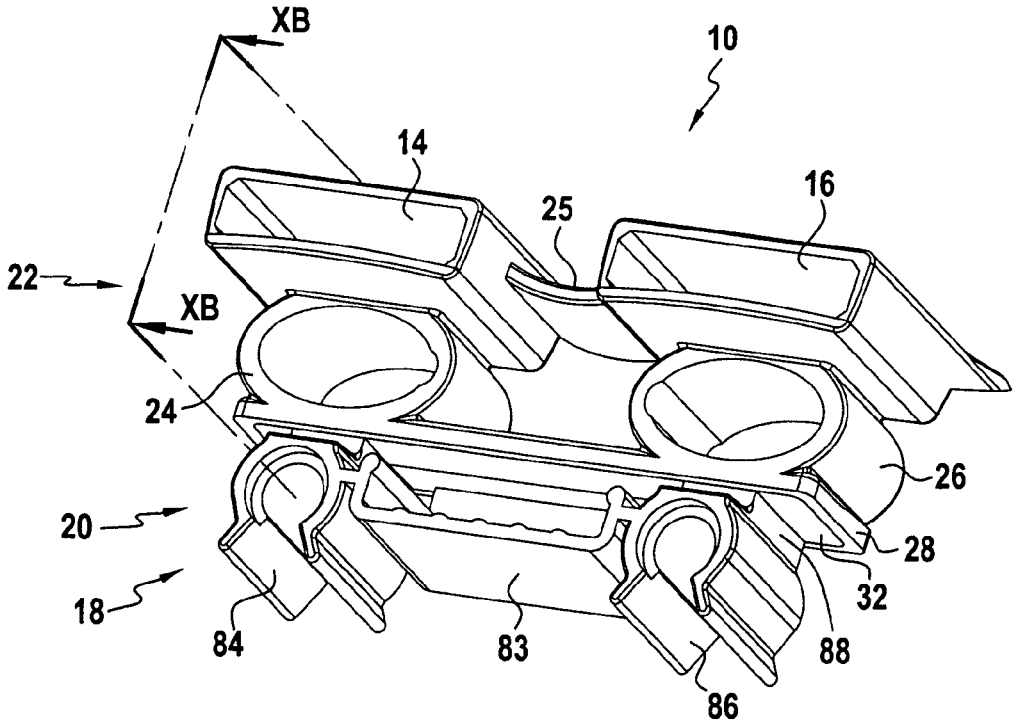
Figure 10B:
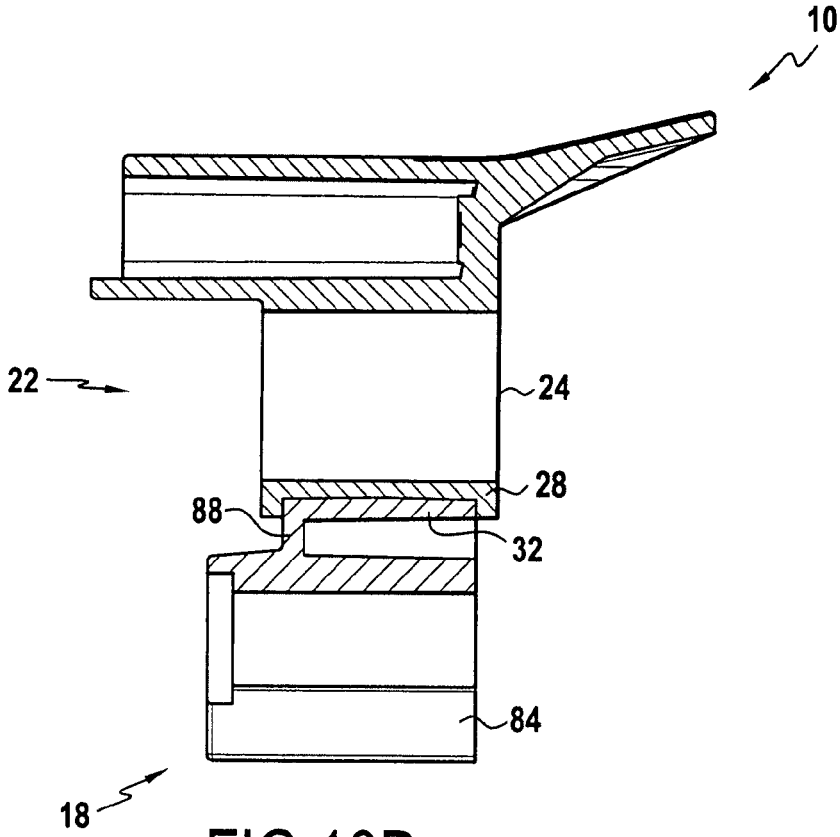

FIG. 3 shows a cutaway view of the cap according to the invention, oriented in the plane III-III of FIG. 2, FIG. 4 shows a back view in perspective of the cap according to the invention, showing a first example of the anchoring means, FIGS. 5A and 5B show a second example of the means of anchoring the cap according to the invention, FIGS. 6A and 6B show a third example of the means of anchoring the cap according to the invention, FIGS. 7A and 7B show a fourth example of the means of anchoring the cap according to the invention, FIGS. 8A and 8B show a fifth example of the means of anchoring the cap according to the invention, FIGS. 9A and 9B show a sixth example of the means of anchoring the cap according to the invention and FIGS. 10A and 10B show a seventh example of the means of anchoring the cap according to the invention.

Figure 1:
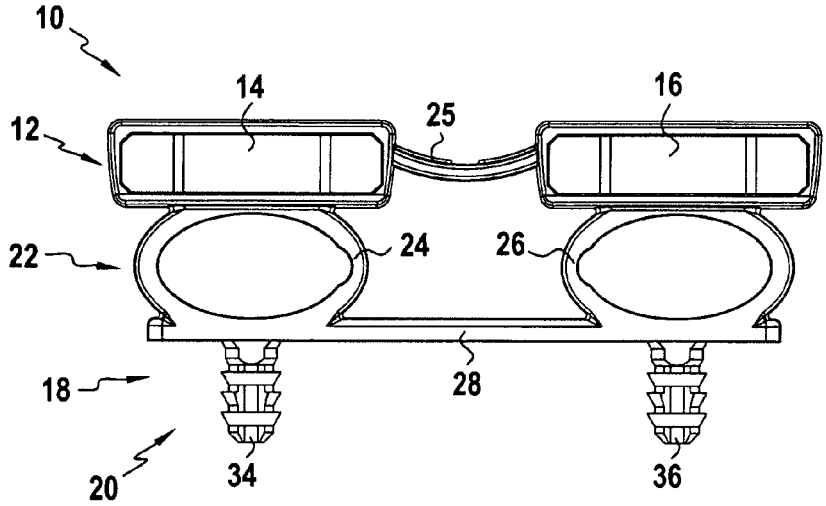
FIG. 1 shows a front view of the cap according to the invention.

In FIG. 1, a cap 10 according to the invention has been shown.

The cap 10 has an upper section 12 which comprises two pockets 14 and 16, forming housings to accept the ends of two parallel slats (not shown here), a lower section 18, which is provided with anchoring means 20 for fastening to a springer frame, not shown here.

Preferentially, the two pockets 14 and 16 are linked together by a wall element 25 and comprise non-slipping elements 27 on their upper faces.

The cap 10 also comprises an intermediate section 22, linking the upper section 12 to the lower section 18.

The intermediate section comprises suspension elements formed by two adjacent sleeves, which are of substantially oval section, 24 and 26 and which run in the transverse direction of the cap 10. Furthermore, each of these two sleeves 24 and 26 supports one of the two pockets 14 and 16.

The two sleeves 24 and 26 are linked together by their lower parts via a connection plate 28 which, for the purposes of the invention, belongs to the intermediate section 22.

Preferentially, this connection plate 28 has a protruding peripheral rim 30.

As can be seen with the aid of FIG. 3, the connection plate is suitable for housing, in its recessed lower face, the section of a substantially rectangular plate 32, holding the anchoring means 20.

The anchoring means 20 will now be described in greater detail.

According to a first example of the anchoring means shown in FIG. 4, these take the form of two studs, 34 and 36, running at right angles from the surface of the plate 32 and arranged substantially under each of the sleeves 24 and 26, substantially along a longitudinal centre-line of the plate 32.

Preferentially, the studs 34 and 36 take the form of Christmas-tree fittings suitable for being inserted into holes provided in the springer frame.

According to a second example of the anchoring means shown in FIGS. 5A and 5B, the studs 34 and 36 are arranged set back from the longitudinal centre-line of the plate 32 in order to adapt the cap 10 to the length of the slats or to the type of springer.

According to a third example of the anchoring means shown in FIGS. 6A and 6B, these also have a housing 58 for a third slat and include studs 34 and 36, similar to those of the second example. As can be seen, the housing 58 takes the form of a cradle running perpendicularly from a connection 62, perpendicular to the plate 32.

According to a fourth example of the anchoring means shown in FIGS. 7A and 7B, these have elastically deformable clipping means 64 and 66. As can be seen in FIG. 7B, the clipping means are intended to clip into an opening provided in a tube 69, this tube preferably being fastened to the springer.

These clipping means 64 and 66 take the form of a "U", the stems 68 and 70 of which run substantially in the direction of the slats, while being elastically deformable.

Furthermore, the ends of the stems 68 and 70 take the form of a hook, with the result that the clipping means can be rigidly locked when the latter are clipped into the tube 69.

As can be seen in FIG. 7A, the clipping means 64 and 66 are arranged in openings 72 and 74, formed in a support board 76, running at right angles from the plate 32.

In addition, the part 77 of the plate 32 situated towards the ends of the stems 68 and 70 is suitable for being supported on an upper portion of the tube 69.

According to a fifth example of the anchoring means shown in FIGS. 8A and 8B, the latter include a pair of studs 80 and 82, running from the plate 32 in the longitudinal direction of the slats, each of the studs 80 and 82 being arranged substantially under one of the sleeves 24 and 26. The studs 80 and 82 are intended for being inserted in holes provided in the springer, these holes preferably being horizontal.

The lower part 18 also includes a housing 83 in the form of a cradle for a third slat, the said housing 83 running between the two studs, with which it is integral.

According to a sixth example of the anchoring means shown in FIGS. 9A and 9B, the plate 32 also includes "Ω" shaped sleeves 84 and 86 running substantially in the longitudinal direction of the slats, these "Ω" shaped sleeves 84 and 86 being intended to clip on to studs rigidly locked with the springer (not shown here).

Preferentially, the plate 32 also comprises a housing 83 for a third slat, running between the "Ω" shaped sleeves 84 and 86.

The seventh example of the anchoring means shown in FIGS. 10A and 10B is similar to the sixth example, except that a connection piece 88 is provided between the lower face of the plate 32 and the "Ω" shaped sleeves 84 and 86 so as to obtain a definite distance between centres of the pockets 14 and 16 and of the "Ω" shaped sleeves 84 and 86 which is greater than that of the sixth example.

It is therefore understood that, according to this invention, the cap 10 can be designed so as to adapt advantageously to several configurations of springers and slats.

According to a first embodiment[1] of the invention, the cap is formed from two materials having different rigidities.

[1]Translator: the French "mode" (literally "mode"/"method") here has been taken as an alternative to or abbreviation of "mode de réalisation" (embodiment).

More precisely, the upper and intermediate sections are made of a flexible, elastic material whereas the lower section 18, comprising the plate 32 and the anchoring means 20, is made of a rigid material.

In addition and above all, the cap 10 is formed in one single piece by moulding, advantageously by co-moulding or bi-injection, these moulding processes being known in other connections.

Bi-injection is understood to be the process in which the first material is injected into one or more points of the mould and the second material is simultaneously injected into one or more other points of the mould in order that they each occupy the desired space without mixing with each other.

Co-moulding is understood to be the process in which the rest of the cap is over-moulded on the plate 32.

Advantageously, the cap also comprises reinforcing means 38 formed in the second material of a rigid type.

These reinforcing means 38 take, in the case in point, the form of portions of rings 40 and 42 partially surrounding at least one of the sleeves 24 and 26 between the plate and the pockets. These portions of rings are preferably formed integrally with the plate 32 during moulding.

As the portions of rings 40 and 42 are made of a material more rigid than that forming the sleeves, it is understood that the suspensions formed by the sleeves 24 and 26 are thus stiffened.

According to another variant, the portions of rings 40 and 42 are directly moulded in the material with the sleeves 24 and 26, due particularly to moulding by bi-injection.

According to a second embodiment, the upper section 12 is made of a third material which is more rigid than the first material but more flexible than the second material.

More precisely, it is the pockets 14 and 16 which are made of the third material.

In fact, for better holding of the slats, it is advantageous for the pockets 14 and 16 to be made of a sufficiently rigid material.

Preferentially, moulding of the cap according to the second embodiment is carried out by multi-injection.

For producing the cap according to the invention, materials such as, for example, polypropylene, polyethylene, polystyrene or polyester can be used as materials of the rigid type.

As a material of the flexible type, the following, by way of non-limiting examples, can be used: elastomeric thermoplastic materials of the SBS, SEBS, TPU, TPEE and EVA type.

By way of a non-limiting example, the first material has a hardness of between 30 shore A and 80 shore A, the second material has a hardness of between 30 shore D and 90 shore D and the third material has a hardness of between 80 shore A and 47 shore D.

The invention claimed is:

1. A multi-material springer slats suspension device formed by a cap having an upper section comprising at least one housing for accepting the end of a slat, a lower section provided with means for anchoring the said cap on a springer frame and an intermediate section comprising suspension elements linking the lower section with the upper section, the intermediate section being essentially made of a first material of the flexible type, whereas the lower section is essentially made of a second material which is of the rigid type and which is distinct from said first material, wherein the intermediate section and the lower section are made in one single piece by moulding, wherein the intermediate section comprises a connection plate made of the material of the flexible type having an upper face linked to a lower part of the suspension elements, and a lower face in which a recess is formed, and wherein the lower section comprises a support plate made of the material of the rigid type which is housed in the recess of the connection plate, the anchoring means extending from below the support plate and being directly connected to the support plate.

2. The suspension device according to claim 1, wherein the cap further comprises means for reinforcing the suspension elements, the said means being formed from the second material of a rigid type.

3. The suspension device according to claim 2, wherein the reinforcing means are formed integrally with the lower section.

4. The suspension device according to claim 2, wherein the reinforcing means take the form of portions of rings surrounding at least one of the suspension elements.

5. The device according to claim 4, wherein the portions of rings are formed integrally with the support plate during moulding.

6. The suspension device according to claim 1, wherein the upper section is made of a third material and in that the upper section is formed in one single piece with the lower and intermediate sections.

7. The suspension device according to claim 1, wherein the anchoring means comprise elastically deformable clipping means situated on a support board, substantially at right angles to the support plate.

8. The suspension device according to claim 1, wherein the anchoring means comprise a pair of studs.

9. The suspension device according to claim 1, wherein the anchoring means comprise a pair of "Ω" shaped sleeves.

10. The device according to claim 8, wherein the anchoring means further comprise a housing for a third slat.

11. A process of manufacturing a suspension device according to claim 1, wherein the anchoring means are moulded together with the intermediate section.

12. The manufacturing process according to claim 11, wherein the anchoring means are co-moulded with the intermediate section.

13. The manufacturing process according to claim 11, wherein the moulding is carried out by bi-injection.

14. The manufacturing process according to claim 11, wherein the support plate is over-moulded with the intermediate and upper sections.

15. The device according to claim 1, wherein the connection plate has a protruding peripheral rim.

16. The device according to claim 1, wherein the anchoring means are suitable for being inserted into holes provided in the springer frame.

* * * * *